US011554367B2

(12) United States Patent
Seippel et al.

(10) Patent No.: US 11,554,367 B2
(45) **Date of Patent: *Jan. 17, 2023**

(54) PIPETTE FOR USE WITH A PIPETTE TIP

(71) Applicant: Eppendorf AG, Hamburg (DE)

(72) Inventors: Martin Seippel, Ammersbek (DE); Matthias Kunsch, Hamburg (DE); Burkhardt Reichmuth, Hamburg (DE); Tobias David, Bargteheide (DE); Frank Horstmann, Lensahn (DE); Jens Wilmer, Hamburg (DE); Marc Wilth, Hamburg (DE)

(73) Assignee: Eppendorf AG, Hamburg (DE)

( * ) Notice: Subject to any disclaimer, the term of this patent is extended or adjusted under 35 U.S.C. 154(b) by 402 days.

This patent is subject to a terminal disclaimer.

(21) Appl. No.: 16/735,066

(22) Filed: Jan. 6, 2020

(65) Prior Publication Data

US 2020/0215528 A1 Jul. 9, 2020

(51) Int. Cl.
*B01L 3/02* (2006.01)
*B01L 9/00* (2006.01)

(52) U.S. Cl.
CPC ..... *B01L 3/0227* (2013.01); *B01L 9/547* (2013.01); *B01L 2300/0609* (2013.01); *B01L 2300/0832* (2013.01); *B01L 2400/0478* (2013.01)

(58) Field of Classification Search
None
See application file for complete search history.

(56) References Cited

U.S. PATENT DOCUMENTS

| | | | | |
|---|---|---|---|---|
| 2005/0175511 | A1* | 8/2005 | Cote | B01L 3/0279 422/522 |
| 2017/0361323 | A1* | 12/2017 | Guzman | B01L 3/0217 |
| 2020/0215529 | A1* | 7/2020 | Tesch | B01L 3/0227 |
| 2022/0016618 | A1* | 1/2022 | Kunsch | B01L 3/0217 |

FOREIGN PATENT DOCUMENTS

| | | |
|---|---|---|
| DE | 27 11 124 | 5/1979 |
| DE | 103 55 914 B3 | 8/2005 |
| DE | 10 2006 036 764 B4 | 11/2012 |
| EP | 0 992 288 B1 | 3/2007 |
| EP | 1 689 528 B1 | 2/2008 |

* cited by examiner

*Primary Examiner* — P. Kathryn Wright
(74) *Attorney, Agent, or Firm* — Edwin E. Voigt, II

(57) ABSTRACT

A pipette for use with a pipette tip includes a housing, a pin on the bottom end of the housing holding a pipette tip having first means for form-fit connection and a second means for form-fit connection which can be shoved onto the pin, constricting the pin, and/or expanding the tip before form-fit connection with the pin, a drive apparatus, at least one locking sleeve arranged concentric to the pin which is guided toward the pin in the housing, wherein the locking sleeve has a locked position having a pin in the inside constricted by shoving on a pipette tip, and/or is bordered on the outside by a tip shoved onto the pin, preventing a release from the pin, and the locking sleeve is upwardly displaceable out of the locked position so that the pin, and/or the tip is released, and the tip is removable from the pin.

19 Claims, 10 Drawing Sheets

52
62
64
4
8
10
53
3
46
47
39,40
38
28
18
37
2
1

73
83
74
79,81
85
86
80,82
82
84
75,77
76,78

73
83
74
79,81
86
85
80,82
82
84
75,77
76,78
39
42
46

PIPETTE FOR USE WITH A PIPETTE TIP

CROSS-REFERENCE TO RELATED APPLICATIONS

This application claims the benefit of European Patent Application Number 19 150 847.2-1101 filed on Jan. 8, 2019, the contents of which is hereby incorporated by reference.

FIELD OF THE INVENTION

The invention relates to a pipette for use with a pipette tip.

BACKGROUND

Pipettes are utilized in particular in scientific and industrial laboratories with medical, molecular biological and pharmaceutical areas of application for dosing selected volumes of liquids. The liquids can in particular be homogeneous (single phase) liquids consisting of a single liquid component, or a homogeneous mixture of a plurality of liquid components (solutions). Furthermore, the liquids can be heterogeneous (multiphase) mixtures of a liquid with another liquid (emulsions), or a solid (suspensions).

Pipettes have a stick-shaped pipette housing with a pin (attachment) on the bottom end for clamping on a pipette tip. The pin is frequently a conical, cylindrical or sectionally conical and cylindrical projection, and is also termed a "working cone". A pipette tip is a hollow tube with a tip opening in the bottom end and a mounting opening in the top end with which the pipette tip can be clamped to the pin. The liquid is drawn into the pipette tip and discharged therefrom. The drawing and discharge of liquid is controlled by means of the pipette. Fixed volume pipettes serve to pipette constant volumes. With variable pipettes, the volume to be dosed is adjustable. A mechanical counter is used to display the set volume. To set the volume, the stroke of a drive apparatus is adjustable by means of a setting apparatus that is coupled to the counter. After use, the pipette tip is detached from the attachment, and can be exchanged for a fresh pipette tip. In this way, cross-contamination of the subsequent pipetting is avoided.

Air cushion pipettes have a plunger/cylinder system in the pipette housing that is connected by a channel to a through-hole in the pin. Pipette tips for air cushion pipettes (air cushion pipette tips) do not have an integrated plunger. By displacing the plunger by means of the drive apparatus in the cylinder, an air cushion is moved for aspirating liquid into a pipette tip clamped onto the pin, and ejecting it therefrom. A disadvantage with air cushion pipettes are dosing errors arising from the change in the length of the air cushion from the weight of the aspirated liquid, and the differences in temperature, air pressure and humidity. Contamination of the pipette with aerosols can also be problematic.

Positive displacement pipettes are used with pipette tips with integrated plungers (positive displacement pipette tips). This type of pipette has a pin for fastening the pipette tip, and a drive apparatus that can be coupled to the integrated plunger (tip plunger) for moving the plunger. The plunger comes directly into contact with the liquid so that the effects of an air cushion do not exist. Positive displacement pipettes are in particular suitable for dosing liquids with a high vapor pressure, high viscosity or high density, and applications in molecular biology in which freedom from aerosols is important in order to avoid contamination.

Air cushion or positive displacement pipette tips for single use or reuse consist of plastic or of glass.

With the Biomaster® 4830 positive displacement pipette by Eppendorf AG, the drive apparatus has a stroke rod to displace a plunger in a pipette tip that has a hollow lower stroke rod part, and an upper stroke rod part inserted from the top into the lower stroke rod part. The upper stroke rod part is connected to an operating element that projects out of the upper end of the pipette housing. A Mastertip® pipette tip by Eppendorf AG can be clamped onto a pin of the pipette. By pressing the operating element, the stroke rod can be shifted downward so that an upper end of the plunger rod of a tip plunger of the pipette tip is pressed into the bottom stroke rod part. When displacing the stroke rod downward to a bottom stop, a spring apparatus is pretensioned. After the operating element is released, the spring apparatus displaces the stroke rod to an upper stop, wherein the tip plunger is entrained and liquid can be aspirated into the pipette tip. The aspirated liquid can be discharged by pressing the operating element to the bottom stop again. To release the pipette tip, the user must press with greater force on the operating element so that another spring apparatus compresses, the upper stroke rod part in the lower stroke rod part is displaced downward and presses the plunger out of the lower stroke rod part, and the pipette tip is pressed off of the pin.

To release the pipette tip from the pipette, the spring effect of the spring apparatuses must be overcome. This can be fatiguing for the user, in particular if the pipette tips have to be exchanged frequently. Furthermore when dispensing highly viscous liquids and when quickly dispensing liquids from the pipette tip, it can occur that the pipette tip is released from the pin due to the increased flow resistance in the tip opening.

EP 0 992 288 B1 describes a pipette with an ejection apparatus for a pipette tip in which a traction gear, pressure gear or linkage is integrated. Due to the transmission ratio of the gear, the ejection rod acting on the pipette tip travels a shorter path than the drive rod connected to an ejection button so that the ejection force is greater than the force for actuating the ejection apparatus. The ejection apparatus is in the pipette housing on the side next to the drive apparatus for the displacement apparatus, whereby the pipette has a large overall volume. The pipette has the ejection button in addition to the operating button so that the user must grasp in order to eject the pipette after pipetting.

DE 103 55 914 B3 describes a pipette with an ejection apparatus that converts an axial movement of the actuating button into an axial and rotary movement of the ejector relative to the attachment. This reduces the applied force for actuating the ejector.

EP 1 689 528 B1 describes a pipette with a tip removal mechanism that contains a ramp member which is rotatable, has a circle-forming ramp surface and contains one or more segments, wherein the ramp surface has a high point and a low point in each segment. While rotating the ramp surface over a single segment, this forces an ejection element of the ejection apparatus to first move toward the tip and then to reverse. The known ejection apparatus is also arranged on the side next to the drive apparatus which makes the overall volume of the pipette large. Moreover, the ejection apparatus has a separate actuating button. This is designed as an electric pushbutton which controls a motor that rotates the ramp member by a gear. The structural complexity of the ejection apparatus is great.

DE 27 11 124 C2 describes a pipette that is connectable via a bayonet lock to a pipette tip. The pipette tip must be manually removed from the pipette. This may result in contamination.

DE 10 2006 036 764 B4 describes a pipette tip which has a latching element to latch with a mounting shaft, and a sealing region for sealing against the mounting shaft. In the region of the latching element, the pipette tip has a wall weakened by at least one slot running in the axial direction of the pipette tip. This can facilitate the sealing fixation of the pipette tip on the mounting shaft and the removal of the pipette tip from the mounting shaft. When pipetting highly viscous liquids and when pipetting quickly, the pipette tip can be pressed off of the shaft.

GENERAL DESCRIPTION OF THE INVENTION

Against this backdrop, the object of the invention is to provide a pipette wherein the forces are reduced for connecting a pipette tip to the pin and for removing the pipette tip from the pin, and the pipette tip is nonetheless held sufficiently tightly on the pin so that it is not released from the pin when pipetting highly viscous liquids and when pipetting quickly.

The pipette according to the invention for use with a pipette tip comprises:

- a rod-shaped pipette housing,
- a pin on the bottom end of the pipette housing for holding a pipette tip that has first means for the form-fit connection to a pipette tip so that a pipette tip, that has second means for the form-fit connection to the first means for the form-fit connection, can be shoved onto the pin while elastically constricting the pin, and/or while elastically expanding the pipette tip before its form-fit connection with the pin,
- a drive apparatus for displacing the displacement element for aspirating a liquid specimen into a pipette tip held on the pin, and ejecting the specimen from the pipette tip,
- at least one locking sleeve arranged concentric to the pin and which is displaceably guided toward the pin in the pipette housing,
- wherein the at least one locking sleeve is displaceable into a locked position in which it is bordered on the inside by a pin which can be constricted by shoving on a pipette tip, and/or is bordered on the outside by a pipette tip that is expandable by being shoved onto the pin, whereby the locking sleeve prevents a release from the pin of a pipette tip that is connected in a form-fit to the pin, and the locking sleeve is upwardly displaceable out of the locked position so that the pin, and/or the pipette tip, is at least partially released, and the pipette tip is removable from the pin.

With the pipette according to the invention, the first means for the form-fit connection and the second means for the form-fit connection are designed complementary to each other so that they engage in a form-fit connection with each other when the pipette tip assumes a certain position on the pin. Connecting the pipette tip to the pin is facilitated in that the pin is elastically constricted by shoving on the pipette tip, and/or the pipette tip is elastically expanded by the penetration of the pin. The elastic constriction and/or expansion is effectuated by the forces acting between the first and second means for the form-fit connection when shoving the pipette tip onto the pin. The elastic constriction and/or elastic expansion is entirely or partially reversed if, when shoving on, the second means for the form-fit connection of the pipette tip engage in the form-fit connection with the first means for the form-fit connection of the pin. Then the at least one locking sleeve is displaced into the locked position. This secures the pipette tip on the pin since the locking sleeve in the locked position prevents the pin from elastically constricting, and/or the pipette tip from elastically expanding, which is necessary to release the form-fit connection between the pin and pipette tip. To eject the pipette tip from the pipette, the locking sleeve is removed from the locked position so that it at least partially releases the pin and/or the pipette tip, and the pin can be elastically constricted, and/or the pipette tip can be elastically expanded. Consequently, the form-fit connection is releasable with a slight exertion of force, and the pipette tip is releasable from the pin.

According to one embodiment of the invention, the pin has at least one slot running in the longitudinal direction, and the locking sleeve in the locked position borders the pin on the inside, and/or the locking sleeve, in locked position, is designed to border a pipette tip on the outside having at least one slot running in the longitudinal direction at the upper end and connected in a form-fit to the pin. According to the first version, the pin has at least one slot running in a longitudinal direction for the elastic constriction. In this case, the pin can consist of a hard elastic or soft elastic material, such as a metal or plastic. A pin produced from a soft elastic material such as from silicone rubber, a thermoplastic elastomer or rubber can also have sufficient elasticity for elastic constriction without a slot. According to the second version, the pipette tip has at least one slot running in a longitudinal direction at the upper end for the elastic expansion. In this case, the pipette tip can consist of a hard elastic plastic such as polypropylene or polyethylene, or soft elastic plastic. It is furthermore possible to produce a pipette tip from a soft elastic material at least at the upper end, for example from silicone rubber, a thermoplastic elastomer or from rubber so that it has sufficient elasticity for elastic expansion without a slot. The pipette tip can be produced by multi-component injection molding from a plurality of materials. In so doing, the various materials can be connected to each other in a form-fit and/or chemically. The locking sleeve is designed so that it does not deform when stressed with a radial force that is suitable to elastically constrict the pin, and/or elastically expand the pipette tip. The locking sleeve consists for example of a metal, or a hard elastic, or rigid plastic.

According to another embodiment, the locking sleeve is connected to a first operating element projecting from the pipette housing and displaceable relative to the pipette housing in order to displace the locking sleeve downward into the locked position, and upward out of the locked position, by actuating the first operating element. The displacement of the locking element into the locked position and upward out of the locked position is simplified for the user by means of the first operating element. In another embodiment that is structurally simpler, the locking sleeve is not connected to a first operating element, but is rather manually displaceable.

According to another embodiment, the pipette has an ejection apparatus that comprises an ejection rod which is displaceably guided in the housing in the longitudinal direction of the pin, and comprises a second operating element connected to the ejection rod in order to displace the ejection rod, wherein the ejection apparatus is designed to press a pipette tip held on the pin off of the pin by displacing the ejection rod downward when the locking sleeve at least partially releases the pin and/or the pipette tip. This facilitates the ejection of the pipette tip on the part of the user and prevents contamination, in particular because the user does not have to grasp the pipette tip in order to remove it from the pin. In a structurally simple embodiment that does not have an ejection apparatus, the user can remove the pipette tip manually from the pin.

According to another embodiment, the pipette is a positive displacement pipette, or an air cushion pipette.

According to another embodiment, (i.) in an embodiment as a positive displacement pipette, the ejection rod is arranged within an axial bore in a stroke rod for displacing a tip plunger in the pipette tip, and is arranged with the lower end above a seat of the stroke rod for the lower end of the tip plunger of a pipette tip held on the pin and engaging with the tip plunger in a through bore of the pin, and (ii.) in an embodiment as an air cushion pipette, a displacement apparatus with a displacement element that can be displaced by a drive element of the drive apparatus is present in the pipette housing and is connected to a through bore in the pin, and the lower end of the ejection rod is arranged on the side next to the pin. According to the first version (i.), the ejection of a pipette tip including a tip plunger of a positive displacement pipette is achieved, and in the second version (ii.), the ejection of a pipette tip of an air cushion pipette is achieved.

According to another embodiment, the locking sleeve and the ejection rod are connected to a gear apparatus that comprises the first operating element and the second operating element, and is designed to control the displacement of the locking sleeve and the ejection rod in an opposite direction when at least one operating element is actuated so that a pipette tip held on the pin is prevented from being removed from the pin by displacing the ejection rod upward and the locking sleeve downward, and the pipette tip can be removed from the pin by displacing the locking sleeve upward and the ejection rod downward. By means of the gear apparatus, synchronized displacement of the locking sleeve and the ejection rod is enabled in opposite directions in order to either securely hold the pipette tip on the pipette, or to release the secure grip of the pipette tip and remove the pipette tip from the pipette. This facilitates the use of the pipette tip on the part of the user.

According to another embodiment, when pressing off a pipette tip, the gear apparatus is designed to first displace the locking sleeve upward, and then the pipette tip is pressed off of the attachment by displacing the ejection rod downward. Consequently, the pipette tip is pressed off of the pin only after the secure grip of the pipette tip on the pin is released. According to another embodiment, the ejection rod already presses against to the pipette tip when the locking sleeve is located in the locked position.

According to another embodiment, the same operating element controls the displacement of the locking sleeve and the displacement of the ejection rod. In this embodiment, the first operating element is simultaneously the second operating element. According to another embodiment, the same operating element controls the drive apparatus. According to another embodiment, the operating element drives the drive apparatus.

This enables a single-handed operation of the pipette without grasping. According to another embodiment, the pipette has an operating element for actuating the locking sleeve and the ejection apparatus, and another operating element different from this operating element for controlling the drive apparatus.

According to another embodiment, the gear apparatus is a gear train that has two outputs with a first and a second output-side rack which is connected to the locking sleeve and the ejection rod, and that has a first drive with a first drive-side rack that is connected to a first actuating element, wherein the first drive-side rack is connected to the second output-side rack via a drive pinion and a first output pinion rigidly connected to the drive pinion, and is connected to the first output-side rack via the drive pinion, an intermediate gear and a second output pinion rigidly connected to the intermediate gear. This embodiment enables high ejection forces while using small operating forces.

According to another embodiment, the gear apparatus has a second drive with a second drive-side rack that has a second operating element on the end distant from the first operating element, wherein the two drive-side racks mesh with the same drive pinion on different sides in order to control the movement of the locking sleeve and the ejection rod by optionally actuating one of the two operating elements on different sides of the pipette housing. Since the pipette can be actuated by pressing on an operating element on different sides, the operation of the pipette by left and right-handers is facilitated.

According to another embodiment, the gear apparatus comprises a curved support that is rotatably mounted in the pipette housing, a first sensing element that is guided on a first curve on the circumference of the curved support and projects from an ejection rod that is displaceably guided in the pipette housing in the longitudinal direction of the pin, a second sensing element guided on a second curve on the circumference of the curved support and projects from a control rod that projects upward from the locking sleeve and forms a locking apparatus together with the locking sleeve that can be displaceably guided in the pipette housing in the direction of the pin, and an operating element that projects from the pipette housing and can rotate relative to the pipette housing. The curved support is designed so that, when the operating element is arranged in a start position, the locking sleeve borders the pin on the inside when in a locked position, and/or borders the pipette tip on the outside, whereby the locking sleeve prevents a release from the pin of the pipette tip connected in a form fit to the pin, and the locking sleeve is displaceable upward by rotating the operating element so that the pin and/or the pipette tip is at least partially released, and the ejection rod pushes the pipette tip off of the pin. The gear apparatus with a curved support can be designed as described in the parallel European patent application of today's date by the same applicant entitled "Pipette for use with a pipette tip" with application number EP 19 150 808.4. In this respect, reference is made to the above application, the content of which is hereby incorporated into this patent application.

According to another embodiment, the drive apparatus has a transmission mechanism that is designed to displace a drive element of the drive apparatus alternatingly downward and upward when the operating element is sequentially displaced downward, between which the operating element is displaced upward. This embodiment is advantageous with an operating element that is displaceable in the longitudinal direction of the pin to drive the drive apparatus. In the first downward displacement of the operating element, the drive element is displaced downward out of an upper position into a lower position; in the subsequent upward displacement of the operating element, the drive element retains its lower position, and in the subsequent downward displacement of the operating element, the drive element is displaced back into the upper position. This sequence can be repeated as frequently as desired.

According to another embodiment, the transmission mechanism is at least partially arranged within a curved support designed as a rotating sleeve. This enables space-saving accommodation.

According to another embodiment, the pipette housing and the gear apparatus have a magnet arrangement and/or a spring apparatus that is designed to independently displace the operating element into the start position. The magnet arrangement comprises for example two permanent magnets, or one permanent magnet and one ferromagnetic component. The permanent magnets, or respectively the ferromagnetic component are held on the pipette housing and on the gear apparatus so that they independently displace the operating element into a start position when they approach each other. This can also be achieved by a spring apparatus that is pretensioned when the gear apparatus is displaced out of the start position and seeks to displace the gear apparatus back into the start position.

According to another embodiment, there is a sensing element which is concentric with the pin and is braced against the pipette housing via a spring and can be pretensioned by shoving a pipette tip onto the pin so that, when a pipette tip is released from the pin, the spring relaxes, and the sensing element supports the pressing the pipette tip off of the pin. The sensing element can in particular be a sensing element of a sensing apparatus for sensing the collar of a pipette tip as described in EP 18 168 763.3. In this respect, reference is made to the above application, the content of which is hereby incorporated into this patent application.

According to another embodiment, the pipette tip is a single channel pipette or a multichannel pipette. With a multichannel pipette, the curved support can control the ejection rod of a multichannel injector.

BRIEF DESCRIPTION OF THE DRAWINGS

The invention is explained below based on the accompanying drawings of an exemplary embodiment. In the drawings.

DETAILED DESCRIPTION OF THE PREFERRED EMBODIMENTS

In the present application, the expressions "upper" and "lower" as well as "vertical" and "horizontal" and terms derived therefrom such as "above" and "below", "standing upright" and "upside down" as well as "over each other" refer to an arrangement of the pipette in which the pin is oriented vertically, and is located on the downwardly facing end of the pipette housing. With regard to the pipette tip, these expressions refer to a vertical orientation of the middle axis of the pipette tip, wherein the tip opening is arranged at the bottom, and the mounting opening is arranged at the top.

Figure 1:
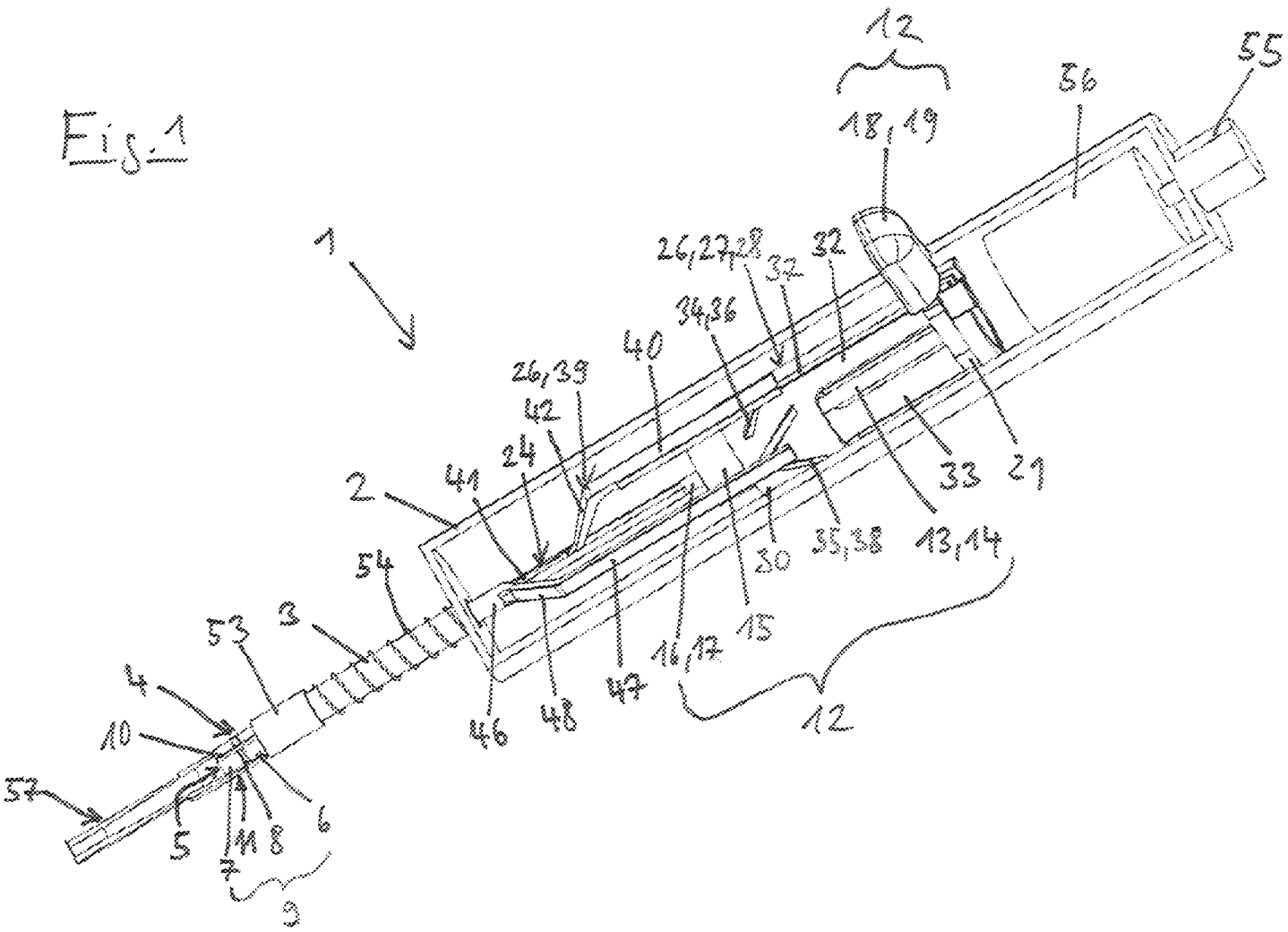
FIG. 1 shows a perspective view of a partially cut away positive displacement pipette with a pipette tip mounted on the pin.
Figure 2:
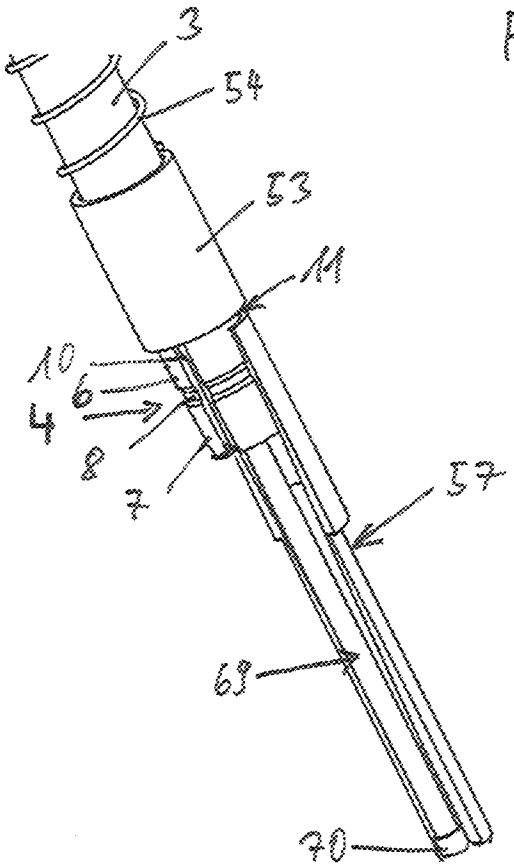
FIG. 2 shows an enlarged perspective view of a slotted pin with an inner adjacent locking sleeve of the same positive displacement pipette with a mounted pipette tip.
Figure 3:
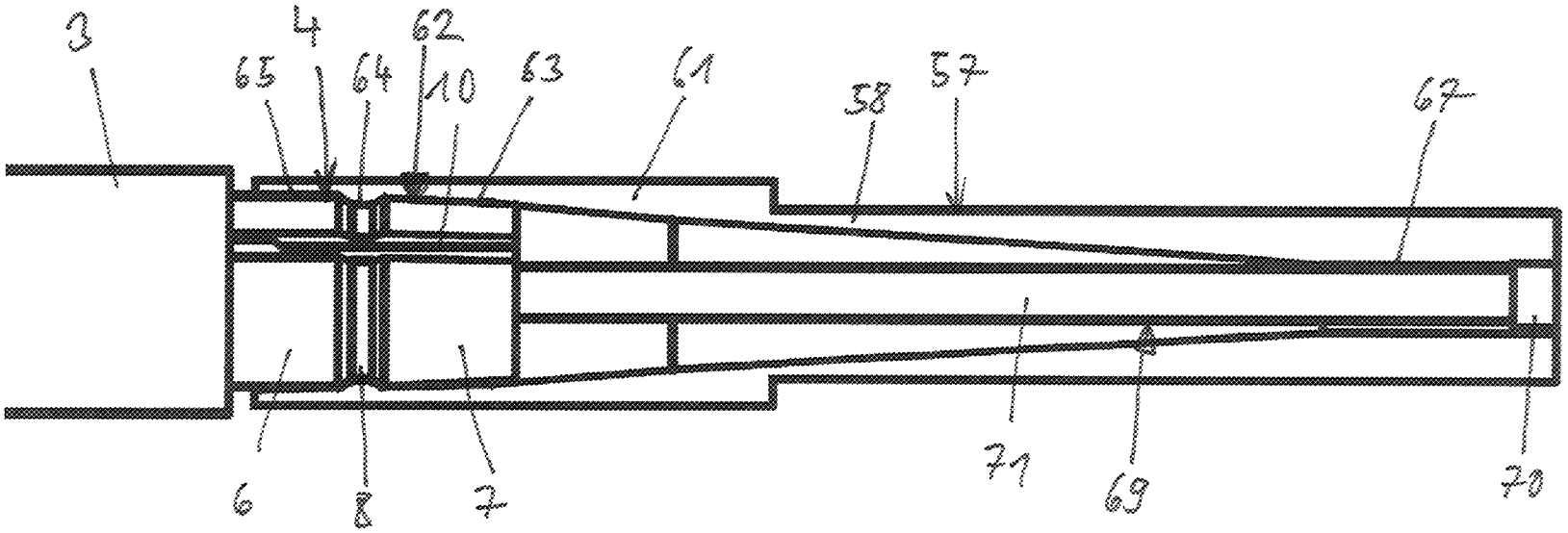
FIG. 3 shows the same arrangement in a side view.

According to FIG. 1, a pipette 1 designed as a positive displacement pipette has a rod shaped (e.g. cylindrical) pipette housing 2. From the bottom end of the pipette housing 2, a hollow cylindrical shaft 3 projects downward. A pin 4 projects downward from the bottom end of the shaft 3 that, according to FIGS. 1 and 4, has a through bore 5 with a through-hole in the bottom end. The inner diameter of the through bore 5 is smaller than the inner diameter of the shaft 3.

The pin 4 has a top pin section 6 in the shape of a hollow cylinder, and underneath, a lower pin section 7 in the shape of a hollow cone. An annular groove 8 runs around the outer circumference of the pin 4 between the upper pin section 6 and the lower pin section 7.

The upper pin section 6, the annular groove 8 and the lower pin section 7 form first means for the form-fit connection 9 of the pipette to a pipette tip.

Furthermore, the pin 4 has two slots 10, 11 running in its longitudinal direction that lie diametrically opposed to each other. The slots 10, 11 extend from the lower end over the entire length of the pin 4.

Figure 5:
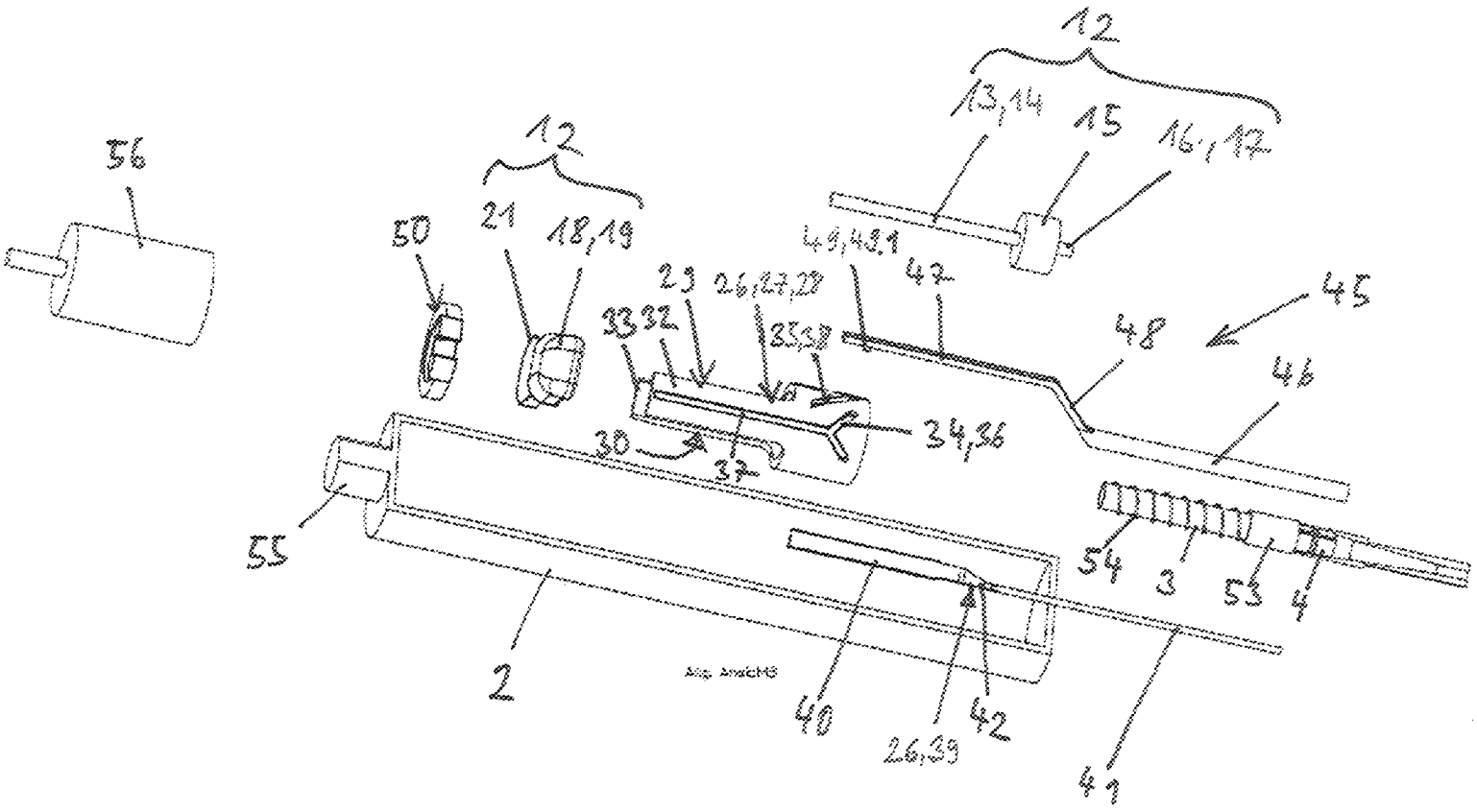
FIG. 5 shows positive displacement pipette from FIG. 1 in an exploded view.
Figure 6:
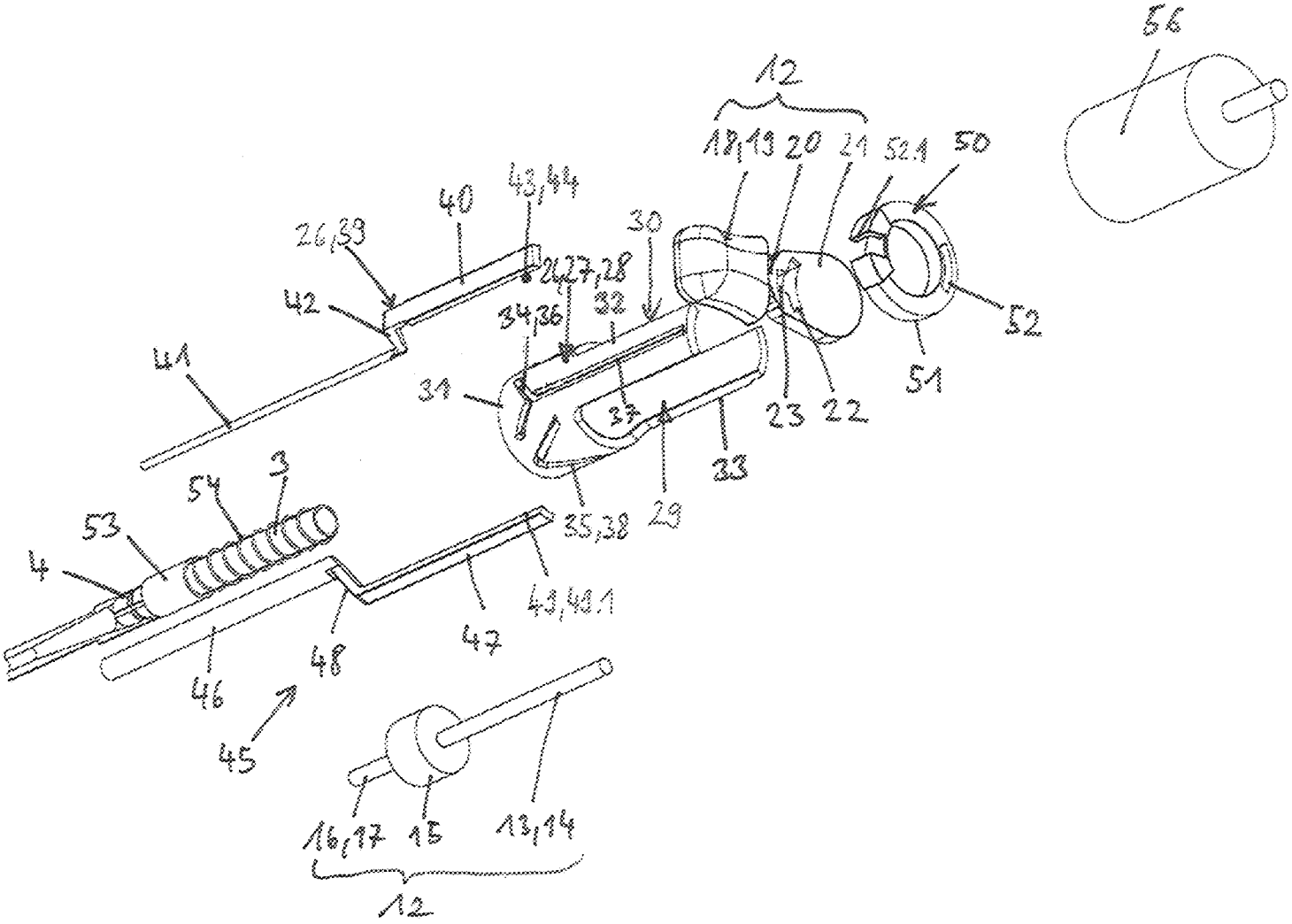
FIG. 6 shows positive displacement pipette from FIG. 1 in an exploded view without pipette housing.

According to FIGS. 1, 5 and 6, there is a drive apparatus 12 in the pipette housing 2 that comprises a transmission element 13 in the form of a transmission rod 14, a transmission mechanism 15 and a drive element 16 in the form of a stroke rod 17. Furthermore, the drive apparatus 12 comprises an operating element 18 in the form of an operating lever 19 that is securely connected via a bar 20 to a support plate 21.

According to FIG. 6, the support plate 21 has an oval shape with a wide, rounded end and a narrow rounded end, wherein the operating lever 19 projects from the edge of the narrow rounded end. In addition to this edge, the support plate 21 has a first curved slot 22 that runs approximately parallel to the contour of the narrow rounded end. Furthermore, the support plate 21 has a rectangular, first edge cutout 23 in the middle of the first curved slot 22 on the side of the narrow rounded end.

According to FIGS. 1 and 5, the stroke rod 17 is inserted from above into the shaft 3 and the pin 4. According to FIG. 4, it is hollow and provided with a longitudinal slot 24 running in a longitudinal direction starting from the lower end. Because of the longitudinal slot 24, the stroke rod 17 has a C-shaped cross-section. Its lower end forms a seat 25 for the upper end of a plunger rod.

The transmission mechanism 15 is designed so that the stroke rod 17 is alternatingly displaced downward and upward during sequential downward displacements of the operating lever 19 between which the operating lever 19 is displaced upward. Consequently, by pressing the operating lever 19 downward, the stroke rod 17 can be displaced out of an upper position into a lower position, the stroke rod 17 retains the lower position during the subsequent upward displacement of the operating lever 19, and the stroke rod 17 is again displaced upward by subsequently pressing the operating lever 19. This can be repeated as frequently as desired.

According to FIGS. 1, 5 and 6, the pipette 1 is provided with an ejection apparatus 26. This comprises a curved support 27 that is rotatably mounted in the pipette housing 2 and is designed as a hollow cylindrical rotating sleeve 28. The rotating sleeve 28 is for example rotatably mounted by its outer circumference on the inner circumference of the pipette housing 2, and the upper and lower ends are braced against ledges of steps on the inner circumference of the pipette housing 2 so that they cannot be displaced in an axial direction in the pipette housing 2. The rotational axis of the rotating sleeve 28 coincides with the longitudinal axis of the pipette housing 2 and the longitudinal axis of the pin 4.

The rotating sleeve 28 has parallel cutouts 29, 30 on two diametrically opposite sides parallel to its rotational axis which extend from the upper edge of the rotating sleeve 28 and terminate at a distance from their lower edge. Below the cutouts, the rotating sleeve 28 accordingly consists of an annular base 31, and it also consists of two diametrically opposing sectors 32, 33 of an annulus that border the two cutouts 29, 30 on the side.

A first curve 34 and a second curve 35 are arranged on the outer circumference of the circular base 31 of the rotating sleeve 28. The first curve 34 is designed as a first groove 36 in the form of an inverted (upside down) Y. The vertical part 37 of the Y extends far upward to a sector 32 just short of the top edge of the sector 32. The second curve 35 is a second groove 38 in the outer circumference of the base 31 of the rotating sleeve 28 in the form of an upright V. The first curve 34 and the second curve 35 are arranged offset 90° relative to each other on the circumference of the rotating sleeve. The first curve 34 and the second curve 35 each extend over an angular range of less than 90° over the circumference of the rotating sleeve 28.

According to FIGS. 1, 5 and 6, the ejection apparatus 26 comprises an ejection rod 39 that comprises a strip-shaped upper ejection rod part 40 and a cylindrical lower ejection rod part 41. The upper and the lower ejection rod part 40, 41 are parallel to each other and arranged laterally offset to each other. The lower end of the upper ejection rod part 40 is connected to the upper end of the lower ejection rod part 41 by a strip-shaped connecting rod part 42 angled obliquely relative to the two ejection rod parts. A first sensing element 43 in the form of a first guide pin 44 extends at a right angle from the inside of the upper ejection rod part 40. The ejection rod 39 is preferably designed as a single part, for example from a rigid plastic.

Figure 4:
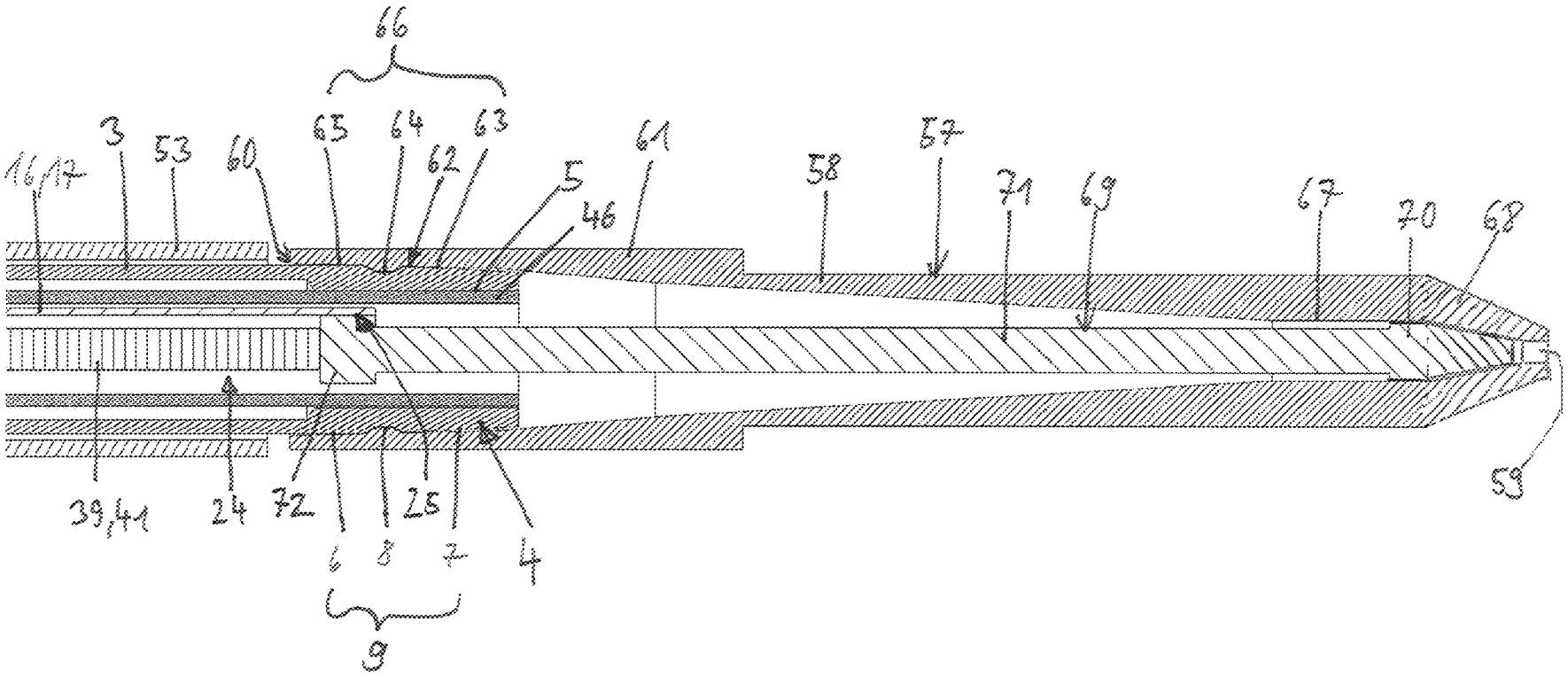
FIG. 4 shows the same arrangement in a longitudinal view.
Figure 7:
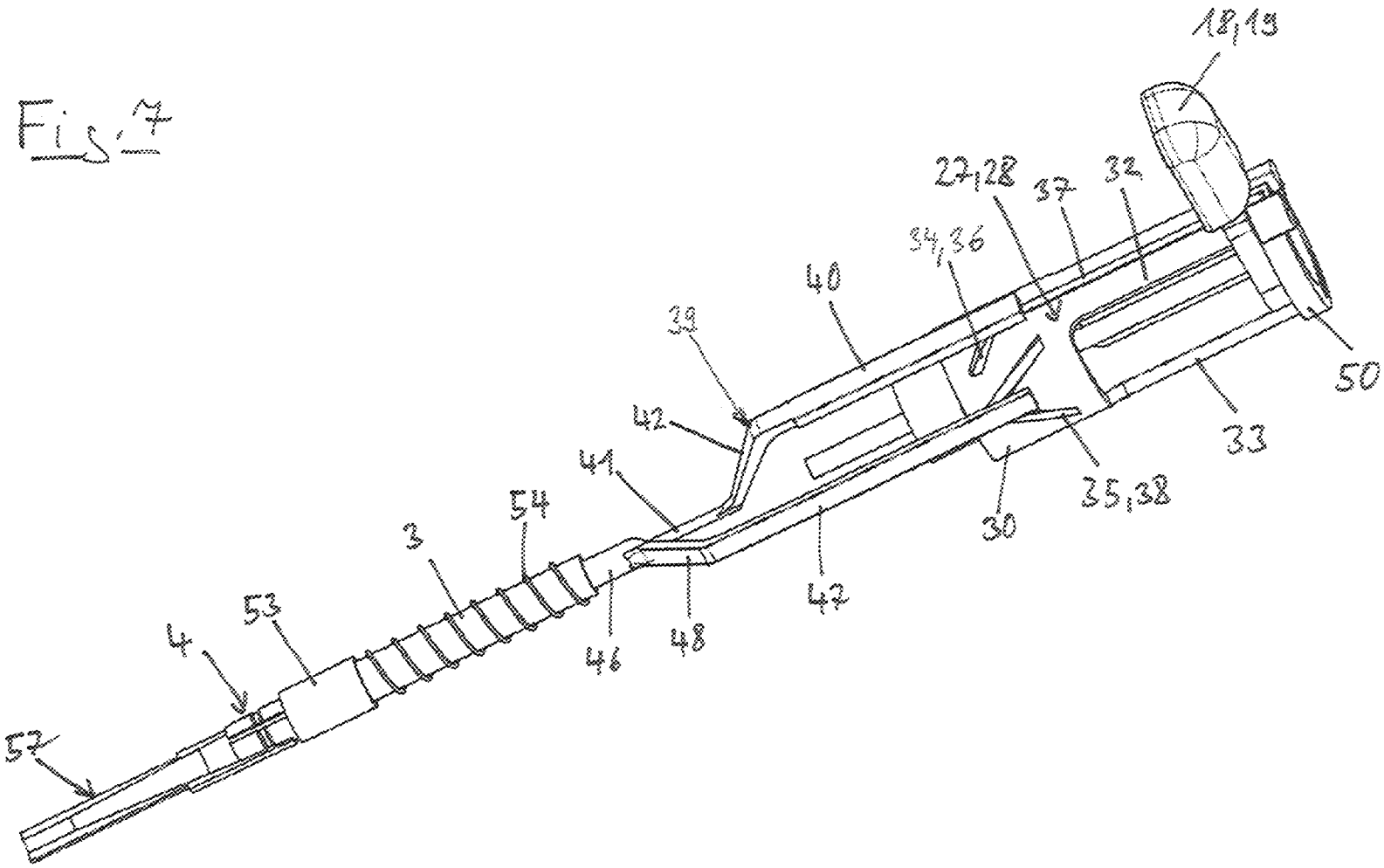
FIG. 7 shows a perspective view of a rotating sleeve with the ejection rod and the locking sleeve of the same positive displacement pipette in the start position.

According to FIGS. 1, 4 and 7, the ejection rod 39 is guided by the guide pin 44 into the first groove 36, the connecting rod part 42 penetrates the longitudinal slot 24 of the stroke rod 17, and the lower ejection rod part 41 extends within the stroke rod 17 almost up to the lower bottom end thereof.

According to FIGS. 1, 4, 5 and 6, the pipette 1 comprises a locking apparatus 45 that comprises a locking sleeve 46 and a strip-shaped control rod 47 parallel thereto. The upper end of the locking sleeve 46 and the lower end of the control rod 47 are connected to each other by a second connecting rod part 48 that is angled obliquely to the locking sleeve 46 and to the control rod 47. A second sensing element 49 in the form of a second guide pin 49.1 extends from the inside of the control rod 47.

According to FIGS. 1 and 7, the second guide pin 49.1 is guided in the second groove 38. According to FIGS. 1 and 4, the locking sleeve 46 is inserted from above into the shaft 3 and lies against the inner side of the pin 4. The stroke rod 17 and the ejection rod 39 are inserted from above into the locking sleeve 46.

With the first curved slot 22, the operating element 19 is shoved onto the sector 32 of the rotating sleeve 28 on which the first groove 36 extends. According to FIGS. 1, 6 and 7, the rotating sleeve 28 is connected at the top to a support ring 50 that bridges the two sectors 32, 33 and stabilizes the rotating sleeve 28. On the outer edge, the support ring 50 has a downwardly projecting casing 51 that laterally surrounds the outer edges of the two sectors 32, 33. Furthermore, it has a second curved slot 52 that accommodates the upper edge of the sector 33 which is not provided with a groove 36, 38. On the diametrically opposite side, there is a rectangular second edge cutout 52.1 in the casing 51 that is open at the bottom and is designed to accommodate the web 20 between operating lever 19 and support plate 21.

The support ring 50 is for example connected to the rotating sleeve 28 by adhesion.

The rotating sleeve 28 and the locking sleeve 46 as well as the operating element 18 are for example made of one or more rigid plastics and/or metal. The rotating sleeve 28, the support ring 50, the operating element 18 and/or the locking sleeve 46 are preferably each designed as a single part. An operating button of the operating element 18 can also be produced from an elastic or soft elastic plastic or rubber.

So that it can be operated from the outside, the operating lever 19 extends out of the pipette housing 2 through a first housing slot running transverse to the longitudinal axis of the pipette housing 2 and extending over a part of the circumference of the pipette housing 2. The first housing slot is connected in the middle to a second housing slot running in the longitudinal direction of the pipette housing 2.

Opposite the effect of a spring apparatus, the operating lever 19 can be displaced downward, starting from the support ring 50, along the second housing slot, wherein it slides with the first curve slot 22 on the sector 32 of the rotating sleeve 28. After being relieved, the spring apparatus independently displaces the operating lever 19 upward.

A sleeve-shaped third sensing element 53 is guided on the outside of the shaft 3. A spring apparatus in the form of a helical spring 54 guided on the shaft abuts the bottom side of the pipette housing 2 and the top side of the third sensing element 53. By means of the helical spring 54, the third sensing element 53 is pressed from above against a stop element on the shaft 3 or the pin 4.

An adjusting knob 55 for adjusting a metering volume is adjusted on the top side of the pipette housing 2. The metering volume can be adjusted by turning the adjusting knob 55. A counter 56 arranged thereunder in the pipette housing 2 indicates the respectively adjusted metering volume. The adjusting knob 55 and/or the counter 56 is coupled to the transmission mechanism 15. The transmission mechanism 15 is designed to change the stroke of the stroke rod 17 corresponding to the respectively adjusted metering volume, which stroke is executed by the downward displacement of the operating element 18.

According to FIGS. 1 and 4, a pipette tip 57 is mounted on the pin 4. The pipette tip 57 comprises a tubular body 58 that has a tip opening 59 in the bottom end, a collar 61 having a mounting opening 60 on the top end, and a seat region 62 on the inner circumference of the collar 61 for clamping onto the pin 4. The seat region 62 has a contour complementary to the pin 4 that has a conical, lower seat section 63 at the bottom for accommodating the conical lower pin section 7, above which is a peripheral bead 64 for engaging in the annular groove 8 of the pin 4, and above which is a cylindrical upper seat section 65 for accommodating the cylindrical upper pin section 6. The lower seat section 63, the bead 64, and the upper seat section 65 form second means for the form-fit connection 66 of the pipette tip 57 with the pipette 1.

Below the seat region, 62, the tubular body 58 has a cylindrical plunger travel region 67. Thereunder, the tubular body 58 has a downwardly tapering tip section 68 with the shape of a conical frustum. The tip section 68 is shown in FIG. 4 and is omitted in the other drawings for reasons of simplification. A tip plunger 69 is inserted into the tubular body 58. This comprises a plunger 70 that is guided in the plunger travel region 67. A plunger rod 71 projects upward from the plunger 70 and has a smaller diameter than the plunger 70. At the top end, the plunger rod 71 has a plunger head 72. According to FIG. 4, the plunger head 72 is pressed downward into the seat 25 of the stroke plunger 17.

Figures 8, 9, 10:
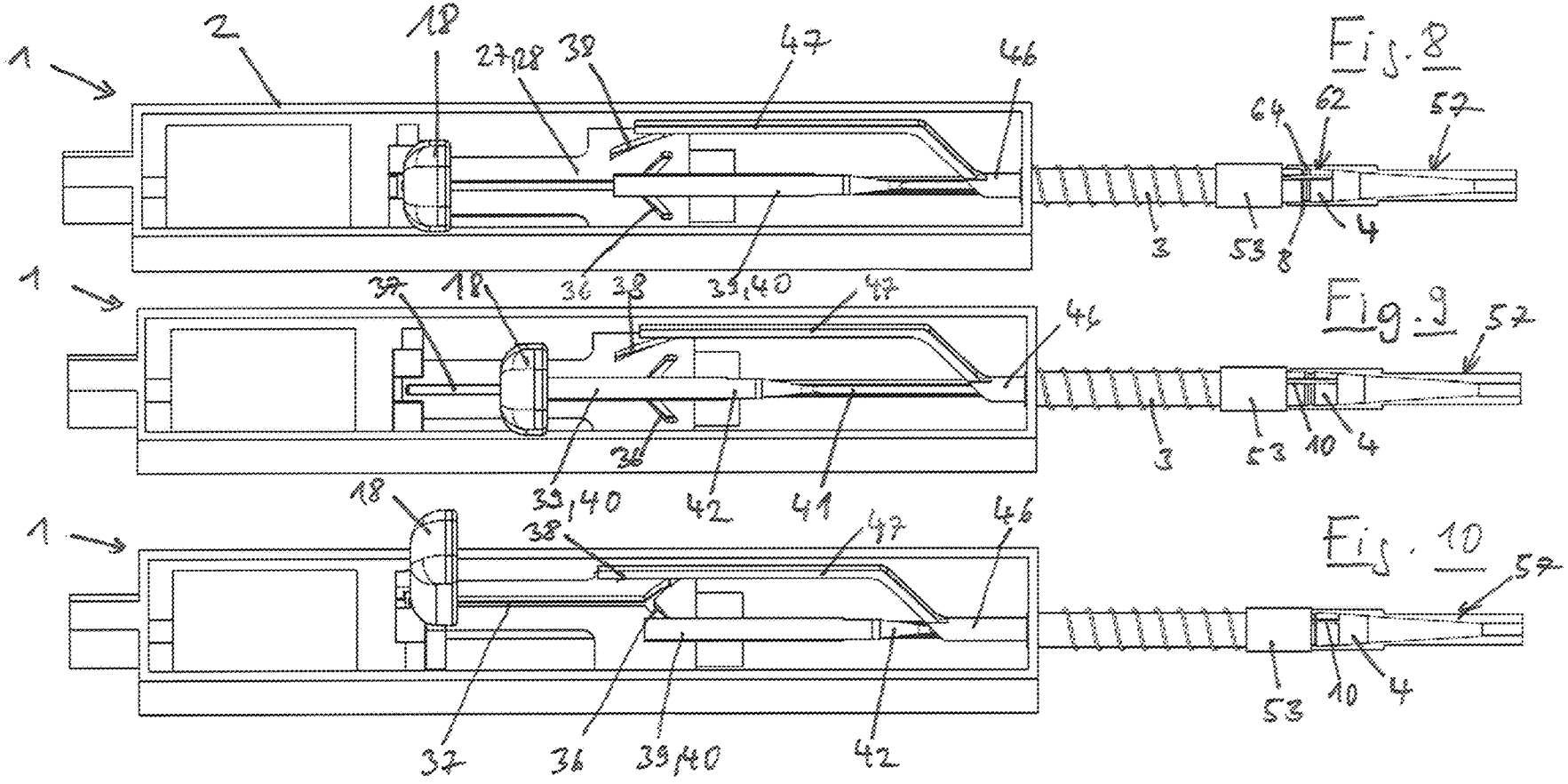
FIG. 8 shows a partial cutaway of the same positive displacement pipette in the start position in a side view.
FIG. 9 shows a partial cutaway of the same positive displacement pipette while pipetting in a side view.
FIG. 10 shows a partial cutaway of the same positive displacement pipette in the start position when ejecting in a side view.

The pipette 1 can be used as follows:

According to FIGS. 1 and 8, a pipette tip 57 is held on the pipette 1 in a starting state. The seat region 62 is in particular connected to the pin 4 in a form-fit by the bead 64 engaging in the annular groove 8. The actuating element 18 is located in the starting position at the top end of the second housing slot and can be screwed into the first housing slot in both directions. The maximum angle of rotation is limited by the extent of the first and second grooves 36, 38 in the circumferential direction, or the first housing slot depending on which extent is smaller.

The locking sleeve 46 is arranged in the lowest position according to FIG. 4 so that it prevents the pipette tip 57 from unintentionally releasing from the pin 4. For the form-fit connection to be released, a radial constriction of the pin 4 would in fact be necessary that the locking sleeve 46 does not permit in this position. In deviation from FIG. 4, the tip plunger 69 in the starting position does not yet press into the seat 25 of the stroke rod 17 with the plunger head 72.

To connect the tip plunger 69 to the stroke rod 17, the operating element 18 is pressed downward. The movement is transmitted by the transmission mechanism 15 to the stroke rod 17 so that it is pressed with the seat 25 onto the plunger head 72. This is shown in FIG. 4.

After being released, the operating element 18 is displaced back into it starting position by a spring apparatus according to FIG. 8. The stroke rod 17 and the tip plunger 69 maintain the positions according to FIG. 4.

To draw liquid, the pipette 1 is immersed in a liquid by the bottom end of the pipette tip 57 held thereon. Then the operating element 18 is again pressed downward. This movement is converted by the transmission apparatus 15 into a stroke movement of the stroke rod 17. As a result, the tip plunger 69 is displaced upward. In so doing, the plunger head 72 entrains the ejection rod 39 so that the first guide pin 44 slides upward in the vertical part 37 of the Y-shaped first groove 36. During this, the locking sleeve 46 retains its position. This is shown in FIG. 9.

Once the operating element 18 has executed the set stroke, the pipette tip 57 is filled with a certain amount of liquid. Then the operating element 18 is relieved and is displaced back upwards by the spring apparatus up to the stop on the support ring 50. To discharge this amount of liquid, the pipette tip 57 of the pipette 1 can be oriented over another vessel. By again pressing the operating element 18 downward, the stroke rod 17 is displaced downward, and the amount of liquid is discharged. In so doing, the first guide pin 44 slides downward to the node of the first groove 36.

The stroke executed by the operating element 18 while drawing and discharging liquid depends on the set amount of liquid.

Drawing and discharging liquid can occur several times.

To eject the pipette tip 57, the operating lever 18 in the starting position is swung to the right or to the left. This rotates the rotating sleeve 28 so that the second groove 38 displaces the second guide pin 49.1, and therefore the locking sleeve 46, upward until the locking sleeve 46 has released the pin 4 until it deforms radially inward. To accomplish this, preferably the locking sleeve 46 is pulled out of the through bore 5. Furthermore by rotating the rotating sleeve 28, the first guide pin 44 is displaced downward in one of the two lateral sections of the bottom part of the first groove 36 so that the ejection rod 39 presses against the tip plunger 69 that abuts the tip section 68 at the bottom. In so doing, the bead 64 exerts a radial force on the pin to constrict it, and the form-fit connection between pipette tip 57 and pin 4 is released. This releases the pipette tip 57 from the pin 4. This is shown in FIG. 10. The scraping of the pipette tip 57 off the pin 4 can be assisted by the sensing element 53 that is pressed by the pretensioned helical spring 54 against the top edge of the pipette tip 57.

Once the used pipette tip 57 is released from the pin 4, a new pipette tip 57 can be connected to the pin 4. To accomplish this, the pipette 1 can be inserted with the pin 4 into the drawing opening 68 of a pipette tip 57 provided in a support. In so doing, the sensing element 53 is displaced upward and pretensions the helical spring 54. Furthermore, the plunger head 72 presses against the bottom side of the ejection rod 39 so that the first guide pin 44 slides up to the first branching point of the first groove 36. In so doing, the rotating sleeve 28 is rotated in the pipette housing 2 until the operating element 18 is located in the starting position. At the same time, the second guide pin 49.1 slides in the second groove 38 to the low point. This displaces the locking sleeve 46 in the locked position in FIG. 4 in which it prevents the pipette tip 57 from releasing from the pin 4.

Connecting the tip plunger 69 to the stroke rod 17 and pipetting can be carried out in the above-described manner.

Figure 11:
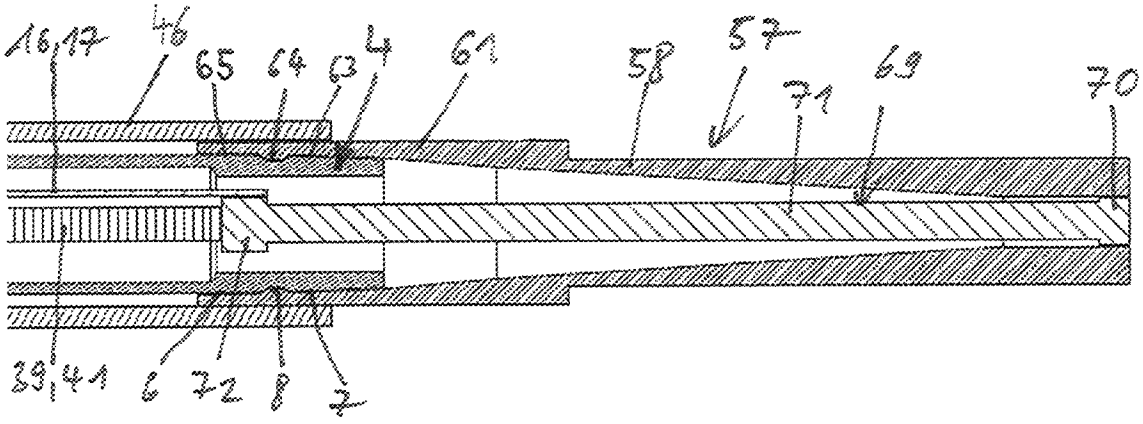
FIG. 11 shows a slotted pipette tip on a pin of another positive displacement pipette with a locking sleeve lying on the outside of the pipette tip in a longitudinal section.

The exemplary embodiment in FIG. 1 differs from that described above in that the locking sleeve 46 is shoved into the locked position beyond the outer circumference of the collar 61 of the pipette tip 57. With this positive displacement pipette, pipette tips 57 are used that have at least one longitudinal slot proceeding from the upper end. The longitudinal slot enables a radial expansion of the pipette tip 57 in order to establish a form-fit connection of the pipette tip 57 with the pin 4. The form-fit connection is prevented from releasing when the locking sleeve 57 is located in the locked position as shown in FIG. 11. To release the pipette tip 57 from the pin 4, the locking sleeve 46 is displaced upward by means of the rotating sleeve 28 as in the above-described exemplary embodiment, and then the pipette tip 57 is released from the pin 4 by pressing against the top side of the tip plunger 69.

Figures 12, 13:
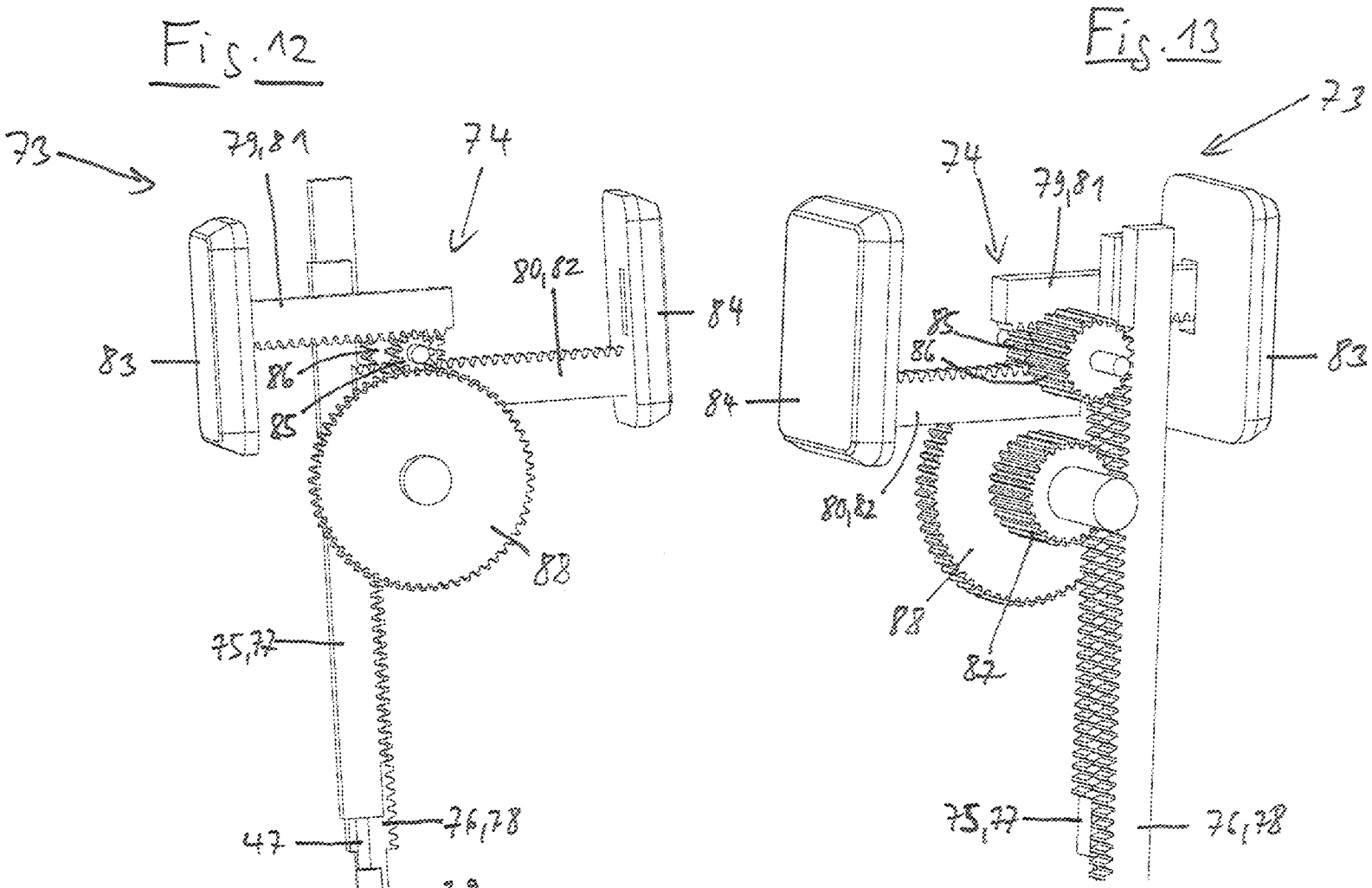
FIG. 12 shows a gear train for displacing the locking sleeve and the ejection rod of a positive displacement pipette in a perspective view obliquely from the front.
FIG. 13 shows the gear train in a perspective view obliquely from below.

According to FIGS. 12 and 13, a gear apparatus 73 is designed as a gear train 74 to displace the locking sleeve 46 and the ejection rod 39. The gear train 74 has two outputs 75, 76 in the form of a first and a second output-side rack 77, 78. The first output-side rack 77 is connected via the control rod 47 to the locking sleeve (46), and the second output-side rack 78 is connected to the ejection rod 39. Furthermore, the gear apparatus 73 has two drives 79, 80 in the form of a first and a second drive-side rack 81, 82. The first drive-side rack 81 is connected at one end to a first operating element 83, and the second drive-side rack 82 is connected at the end remote from the first operating element 83 to a second operating element 84. The two drive-side racks 81, 82 mesh on different sides with the same drive pinion 85. The first and the second drive-side track 81, 82 are connected to the second output-side rack 78 via the drive pinion 85 and a first output pinion 86 rigidly connected to the drive pinion 85, and are connected to the first output-side rack 77 via the drive pinion 85, an intermediate gear 88 and a second output pinion 87 rigidly connected to the intermediate tooth wheel.

The first and the second operating element 83, 84 are arranged on different sides of the pipette housing 2.

By optionally actuating the first operating element 83 or the second operating element 84, the movement of the locking sleeve 46 and the ejection rod 39 can be controlled in different directions.

The gear apparatus 73 with the gear train 74 can be arranged in the pipette housing 2 instead of the gear apparatus with the rotating sleeve 28. The drive apparatus 12 can be separate from the gear apparatus 73, wherein there can be a separate operating element for driving the drive apparatus 12 that is separate from the two operating elements 83, 84 of the gear apparatus 73. This can be an operating element 18 that projects from the pipette housing 2 through a longitudinal slot running in the longitudinal direction of the pipette housing 2 and can be displaced in the direction of the pin 4. The operating element 18 can displace a drive element 16 of the drive apparatus 12 alternatingly downward and upward by means of a transmission mechanism 15 that is designed therefor when the operating element 18 is sequentially displace downward, between which the operating element 18 is displaced upward.

REFERENCE SIGN LIST

1 Pipette
2 Pipette housing
3 Shaft
4 Pin
5 Through bore
6 Upper pin section
7 Lower pin section
8 Annular groove
9 First means for a form-fit connection
10 Slot
11 Slot
12 Drive direction
13 Transmission element
14 Transmission rod
15 Transmission mechanism
16 Drive element
17 Stroke rod
18 Operating element
19 Operating lever
20 Web
21 Support plate
22 First curved slot
23 First edge cutout
24 Longitudinal slot
25 Seat
26 Ejection apparatus
27 Curved support
28 Rotating sleeve
29 Cut-out
30 Cut-out
31 Base
32 Sector
33 Sector
34 First curve
35 Second curve
36 First groove
37 Vertical part
38 Second groove
39 Ejection rod
40 Upper ejection rod part
41 Lower ejection rod part
42 Connecting rod part
43 First sensing element
44 Guide pin
45 Locking apparatus
46 Locking sleeve
47 Control rod
48 Second connecting rod part
49 Second sensing element
49.1 Second guide pin
50 Support ring
51 Casing
52 Second curved slot
52.1 Second edge cutout
53 Third sensing element
54 Helical spring
55 Adjusting knob
56 Counter
57 Pipette tip
58 Body
59 Tip opening
60 Mounting opening
61 Collar
62 Seat region
63 Lower seat section
64 Bead
65 Upper seat section
66 Second means for a form-fit connection
67 Plunger travel region
68 Tip section
69 Tip plunger
70 Plunger
71 Plunger rod
72 Plunger head
73 Gear apparatus
74 Gear train
75 Output
76 Output
77 First output-side rack
78 Second output-side rack
79 Drive
80 Drive
81 First drive-side rack
82 Second drive-side rack
83 First operating element
84 Second operating element
85 Drive pinion
86 First output pinion
87 Second output pinion
88 Intermediate gear

We claim:

1. A pipette for use with a pipette tip comprising:

a rod-shaped pipette housing, a pin on a bottom end of the pipette housing for holding a pipette tip, the pin having a first means for the form-fit connection to the pipette tip, the pipette tip having a second means for the form-fit connection to the first means for the form-fit connection, the pin being elastically contractible or the pipette tip being elastically expandable, wherein the pin elastically contracts to the pipette tip or the pipette tip elastically expands to the pin prior to the form fit connection of the pipette tip onto the pin, a drive apparatus for displacing a displacement element for aspirating a liquid specimen into the pipette tip held on the pin, and ejecting the specimen from the pipette tip, at least one locking sleeve arranged concentric to the pin, the at least one locking sleeve being displaceably guided in an axial direction of the pin in the pipette housing, wherein the locking sleeve is displaceable into a locked position and in an upward direction away from the locked position into an unlocked position, wherein the at least one locking sleeve borders the inside of the pin in the locked position or borders the outside of the pipette tip in the locked position, the locking sleeve preventing the removal of the pipette tip from the pin during the form fit connection of the pipette tip onto the pin, and wherein the locking sleeve in the unlocked position is distal relative to the inside of the pin or the outside of the pipette tip, wherein in the unlocked position the pipette tip is removable from the pin.

2. The pipette according to claim 1, wherein the pin has at least one slot running in a longitudinal direction of the pin, and the locking sleeve in the locked position borders the pin on the inside of the pin, or wherein the locking sleeve in locked position borders the pipette tip on the outside of the pipette tip, the least one slot running in the longitudinal direction at an upper end of the pin.

3. The pipette according to claim 1, wherein the locking sleeve is connected to a first operating element projecting from the pipette housing, the first operating element actuating relative to the pipette housing and displacing the locking sleeve in a downward direction into the locked position, and in the upward direction out of the locked position.

4. The pipette according to claim 1, having an ejection apparatus that comprises an ejection rod which is displaceably guided in the pipette housing in a longitudinal direction of the pin, and the ejection apparatus comprises a second operating element connected to the ejection rod, the second operating element being constructed and arranged to displace the ejection rod, wherein the ejection apparatus is constructed and arranged to press the pipette tip held on the pin, off of the pin by displacing the ejection rod in a downward direction when the locking sleeve at least partially releases the pin or the pipette tip.

5. The pipette according to claim 4, wherein the ejection rod is arranged within an axial bore in a stroke rod, the ejection rod displacing a tip plunger in the pipette tip, and the ejection rod is arranged with a lower end above a seat of the stroke rod for a tip plunger upper end of the tip plunger of the pipette tip held on the pin, and the pipette tip engaging the tip plunger in a through bore in the pin.

6. The pipette according to claim 5, wherein a displacement apparatus having a displacement element is displaced by a drive element of the drive apparatus in the pipette housing, and the displacement apparatus is connected to the through bore in the pin, and the lower end of the ejection rod is arranged proximate to the pin.

7. The pipette according to claim 5, wherein the locking sleeve and the ejection rod are connected to a gear apparatus, the gear apparatus comprising the first operating element and the second operating element, the gear apparatus being constructed and arranged to control the displacement of the locking sleeve and the ejection rod in opposite directions when at least one of the first operating element and the second operating element is actuated wherein the pipette tip held on the pin prevents the tip plunger from being removed from the pin by displacing the ejection rod in the upward direction and the locking sleeve in the downward direction, and wherein the pipette tip is removed from the pin by displacing the locking sleeve in the upward direction and the ejection rod in the downward direction.

8. The pipette according to claim 6, wherein the locking sleeve and the ejection rod are connected to a gear apparatus, the gear apparatus comprising the first operating element and the second operating element, the gear apparatus being constructed and arranged to control the displacement of the locking sleeve and the ejection rod in opposite directions when at least one of the first operating element and the second operating element is actuated wherein the pipette tip held on the pin prevents the tip plunger from being removed from the pin by displacing the ejection rod in the upward direction and the locking sleeve in the downward direction, and wherein the pipette tip is removed from the pin by displacing the locking sleeve in the upward direction and the ejection rod in the downward direction.

9. The pipette according to claim 7, wherein the gear apparatus (73) is constructed and arranged to first displace the locking sleeve in the upward direction, and then the pipette tip is pressed off of an attachment by displacing the ejection rod in the downward direction.

10. The pipette according to claim 7, wherein the first operating element controls the displacement of the locking sleeve and the displacement of the ejection rod.

11. The pipette according to claim 4, wherein the second operating element controls the drive apparatus.

12. The pipette according to claim 7, wherein the gear apparatus is a gear train having a first output having a first output-side rack and a second output having a second output-side rack, the gear train being connected to the ejection rod and the locking sleeve, the gear train having a first drive engaged to the first drive-side rack connected to a first actuating element, wherein the first drive-side rack is connected to the second output-side rack by a drive pinion, and a first output pinion is rigidly connected to the drive pinion, and is connected to the first output-side rack by the drive pinion, an intermediate gear and a second output pinion which is rigidly connected to the intermediate gear.

13. The pipette according to claim 12, wherein the gear apparatus has a second drive having a second drive-side rack having a second operating element having a second operating element end distal relative to the first operating element, wherein the first output-side rack and the second output-side rack mesh with the drive pinion on different sides of the drive pinion controlling the movement of the locking sleeve and the ejection rod by actuating one of the first operating element and the second operation element.

14. The pipette according to claim 7, wherein the second operating element controls the displacement of the locking sleeve and the displacement of the ejection rod.

15. The pipette according to claim 14, wherein the first operating element controls the drive apparatus.

16. The pipette according to claim 1, wherein the pin is elastically contractible and the pipette tip is elastically expandable.

17. The pipette according to claim 1, wherein the pin elastically contracts to the pipette tip and the pipette tip elastically expands to the pin prior to the form fit connection of the pipette tip onto the pin.

18. The pipette according to claim 1, wherein the at least one locking sleeve borders the inside of the pin in the locked position and borders the outside of the pipette tip in the locked position.

19. The pipette according to claim 1, wherein the locking sleeve in the unlocked position is distal relative to the inside of the pin and the outside of the pipette tip.

* * * * *